US006749287B2

(12) United States Patent
Osada et al.

(10) Patent No.: US 6,749,287 B2
(45) Date of Patent: Jun. 15, 2004

(54) INK JET RECORDING HEAD AND INK JET RECORDING APPARATUS

(75) Inventors: Torachika Osada, Kanagawa (JP); Shuzo Iwanaga, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 09/945,699

(22) Filed: Sep. 5, 2001

(65) Prior Publication Data

US 2002/0075337 A1 Jun. 20, 2002

(30) Foreign Application Priority Data

Sep. 6, 2000 (JP) ..... 2000-270221

(51) Int. Cl.[7] ..... B41J 2/14
(52) U.S. Cl. ..... 347/50; 347/49; 347/86
(58) Field of Search ..... 347/49, 50, 57, 347/58, 86

(56) References Cited

U.S. PATENT DOCUMENTS

| | | | | |
|---|---|---|---|---|
| 5,315,472 A | * | 5/1994 | Fong et al. | 347/50 |
| 5,411,343 A | * | 5/1995 | Childers | 347/50 |
| 5,610,635 A | | 3/1997 | Murray et al. | 347/7 |
| 6,053,598 A | * | 4/2000 | Inpyn | 347/49 |

FOREIGN PATENT DOCUMENTS

| | | | |
|---|---|---|---|
| EP | 822 078 | * | 2/1998 |
| EP | 0 822 084 A | | 2/1998 |
| EP | 0 847 866 A | | 6/1998 |
| EP | 0 990 532 A | | 4/2000 |
| EP | 1 172 216 A | | 1/2002 |

OTHER PUBLICATIONS

Patent Abstracts of Japan, vol. 1998, No. 08, Jun. 30, 1998 (JP 10 076647, Mar. 24, 1998).

* cited by examiner

*Primary Examiner*—Michael S. Brooke
(74) *Attorney, Agent, or Firm*—Fitzpatrick, Cella, Harper & Scinto

(57) ABSTRACT

An ink jet recording head includes a plurality of recording element substrates, a supply port, a supporting member for supporting the recording element substrates, an electric contact substrate fixed to the supporting member, and an electric wiring tape connected to the recording element substrates and to the electric contact substrate. The electric contact substrate has a plurality of input terminals that are electrically connected to recording elements of the recording element substrates via the electric wiring tape, and are also electrically connected to terminals of a recording apparatus body. The electric contact substrate is wider than the electric wiring tape. If m equals the maximum number of input terminals arranged in the lateral direction on the electric contact substrate, and n equals the maximum number of input terminals arranged in the longitudinal direction on the electric contact substrate, then m>n.

7 Claims, 14 Drawing Sheets

H1303

| | |
|---|---|
| 1 | B_DIA |
| 2 | B_VH6 |
| 3 | B_GND6 |
| 4 | B_HE1 |
| 5 | B_GND4 |
| 6 | B_VH4 |
| 7 | B_VHT |
| 8 | B_VH2 |
| 9 | B_GND2 |
| 10 | B_DATA_M1 * |
| 11 | B_GND1 |
| 12 | B_VH1 |
| 13 | B_VDD |
| 14 | B_LT |
| 15 | B_VH3 |
| 16 | B_GND3 |
| 17 | B_DATA_M2 * |
| 18 | B_DATA_Y1 * |
| 19 | B_GND5 |
| 20 | B_VH5 |
| 21 | B_VSS |
| 22 | B_SH |
| 23 | B_VH7 |
| 24 | B_GND7 |
| 25 | B_DATA_Y2 * |
| 26 | B_DATA_C1 * |
| 27 | B_GND9 |
| 28 | B_VH9 |
| 29 | B_CLK |
| 30 | B_VH11 |
| 31 | B_GND11 |
| 32 | B_DATA_C2 * |
| 33 | B_GND12 |
| 34 | B_VH12 |
| 35 | B_VH10 |
| 36 | B_GND10 |
| 37 | B_HE2 |
| 38 | B_RANK |
| 39 | B_GND8 |
| 40 | B_VH8 |
| 41 | B_DIK |
| 42 | A_VDD |
| 43 | A_GND1 |
| 44 | A_HF |
| 45 | A_VH1 |
| 46 | A_CLK |
| 47 | A_SH1 |
| 48 | A_VH3 |
| 49 | A_LT |
| 50 | A_GND3 |
| 51 | A_VSS |
| 52 | A_DATA_K2 |
| 53 | A_GND4 |
| 54 | A_VHT |
| 55 | A_VH4 |
| 56 | A_DIA |
| 57 | A_RANK |
| 58 | A_SH2 |
| 59 | A_VH2 |
| 60 | A_DIK |
| 61 | A_GND2 |
| 62 | A_DATA_K1 |

INK JET RECORDING HEAD AND INK JET RECORDING APPARATUS

BACKGROUND OF THE INVENTION

1. Field of the Invention

This invention relates to an ink jet recording head for use in a recording apparatus that performs a recording operation by discharging recording liquid such as ink from a discharge port to form liquid droplets. More particularly, this invention relates to a recording element substrate for use in the ink jet recording head, a wiring substrate that connects the recording device substrate with a power source, and so forth. It should be noted that the ink jet recording head according to the present invention may be applied to an ordinary printing apparatus and other apparatuses such as a copying machine, a facsimile with a communication system, and a word processor having a printing section, and may also be applied to an industrial recording apparatus that is compositely combined with various processing units.

2. Related Background Art

Conventionally, an ink jet recording head is comprised of pads that receive driving pulses for driving liquid discharge elements (e.g. piezoelectric elements and bubble generating electrothermal converting elements) provided in the head. Terminals provided at a head mounting position of a printer are brought into contact with the pads when the ink jet recording head is detachably mounted on the printer. The pads of the ink jet recording head will be increased reasonably according to the increase in the number of liquid discharge elements.

For example, an ink jet recording head disclosed in U.S. Pat. No. 5,610,635 has a memory element and a pad portion disposed in a flexible cable that is directly connected with the head.

The number of discharge elements in an ink jet recording head has increased from 64 for monochromatic recording to 128 or more. In the case of a recording head capable of multicolor recording, the number of discharge elements have been increased. Accordingly, the number of pads required for the recording head has been increased.

On the other hand, an ink jet recording head is usually provided with a holder that is detachably mounted on the head in order to receive discharge ink from a tube or a tank. Among various kinds of ink jet recording heads, a head chip utilizing thermal energy has the advantage of being small in size. The use of such a head chip reduces the size of a plurality of recording heads even if the number of pads is increased.

If forty pads are arranged in the flexible cable of the recording head disclosed in the U.S. Pat. No. 5,610,635 in the case where the number of pads in the ink jet recording head is increased as stated above, the pads must be arranged along the length of the flexible cable since the width of the flexible cable is fixed due to the limitation on the width of the recording head itself. In this case, eight rows of five pads arranged along the width direction of the flexible cable must be arranged along the length direction of the flexible cable. As a result, if the ink jet recording head is electrically connected with a printer body, contact pressure is varied according to the positions of the pads and terminals when a plurality of pads is brought into contact with a plurality of terminals. This increases the poor contact between the pads and the terminals.

Moreover, if the recording head is constructed as disclosed in the specification of the above patent, a memory element or the like provided in the flexible cable may become one of factors that badly affect the contact between the pads of the recording head and the terminals of the carriage.

Further, there is no prior art that enables the proper arrangement of pads according to different structures of heads, and it is therefore necessary to develop the technique for arranging pads reasonably and properly.

SUMMARY OF THE INVENTION

It is therefore an object of the present invention to provide an ink jet recording head, which is detachably mounted in a recording head and has a plurality of input terminals for receiving electric signals from a recording apparatus body, the ink jet recording apparatus being capable of preventing the poor contact between the input terminals of the recording head and the terminals of the recording apparatus body in electric connection thereof even if the number of the input terminals is increased.

In order to attain the above object, there is provided an ink jet recording head, comprising: a plurality of recording element substrates having a plurality of recording elements for discharging a recording liquid, and a supply port for supplying the recording liquid to the recording elements; a supporting member for supporting the plurality of recording element substrates; an electric contact substrate having a plurality of input terminals electrically connected to terminals of a recording apparatus body, and being fixed to the supporting member; an electric wiring tape connected to the plurality of the recording element substrates and the electric contact substrate such that the input terminals of the electric contact substrate are electrically connected to the recording elements of the recording element substrates; and in which the width of the electric contact substrate is wider than that of the electric wiring tape in a lateral direction perpendicular to a longitudinal direction in which the electric contact substrate and the electric wiring tape are arranged, and the input terminals are arranged in the lateral direction and the longitudinal direction on one surface of the electric contact substrate, and a relationship of $m>n$ is satisfied if the maximum number of the input terminals in the lateral direction is assumed to be m and the maximum number of input terminals in the longitudinal direction is assumed to be n. Preferably, n is equal or less than 5.

It is preferred that the maximum number m of the input terminals are arranged in the lateral direction on one surface of the electric contact substrate, and rows of the m input terminals arranged in the lateral direction and extending in the lateral direction are arranged in the longitudinal direction in the same number as the maximum number n in the longitudinal direction.

According to the invention described above, in the ink jet recording head in which the respective recording element substrates are electrically connected to the electric contact substrate fixed on the supporting member supporting the recording element substrates through the electric wiring tape, the width of the electric contact substrate is wider than that of the electric wiring tape in the lateral direction perpendicular to the direction in which the electric contact substrate and the electric wiring tape are arranged. This reduces the number of input terminals on the electric contact substrate, and arranges a plurality of input terminals on the electric contact substrate while preventing them from being arranged in the form of an oblong. More specifically, the input terminals are arranged in the lateral and longitudinal directions on one surface of the electric contact substrate, and the relationship of m>n is satisfied if the maximum number of the input terminals in the lateral direction is assumed to be m and the maximum number of input terminals in the longitudinal direction is assumed to be n. Therefore, the input terminals are arranged in the form of a rectangle on the electric contact substrate. In the case where the input terminals are arranged in the form of a rectangle, the farthest input terminals from the recording element substrates among the input terminals on the electric contact substrate can be closer to the recording element substrates than in the case where the input terminals are arranged in the form of an oblong. If the ink jet recording head is mounted on the carriage of the recording apparatus body or the like, a portion of the ink jet recording head by the side of the recording element substrates is positioned and fixed. Thus, if the input terminals are arranged in the form of a rectangle on the electric contact substrate so that the farthest input terminals from the recording element substrates among the input terminals on the electric contact substrate can be close to the recording element substrates, the contact pressure can be prevented from varying according to the positions of the terminals when the input terminals and the terminals of the carriage are brought into contact with one another in electric connection thereof. This significantly reduces the poor contact between the input terminals on the electric contact substrate of the ink jet recording head and the terminals of the recording apparatus body in the electric connection thereof, and reduces the size and cost of the ink jet recording head.

It is preferred that one of the recording element substrates is a black recording element substrate for use in discharging a black recording liquid, and among the input terminals on the electric contact substrate, only the input terminals electrically connected to the black recording element substrate are arranged in an outermost row at an opposite side of the electric wiring tape.

If only the input terminals electrically connected to the black recording element substrate for use in discharging a black recording liquid among the input terminals on the electric contact substrate are arranged in the outermost row at the opposite side of the electric wiring tape as stated above, only erasing the outermost row at the opposite side of the electric wiring tape among the input terminals on the electric contact substrate enables the manufacture of an ink jet recording head having no black recording element substrate without the need for redesigning the electric contact substrate.

It is also preferred that the plurality of the input terminals are arranged such that head driving voltage input terminals, logic system voltage input terminals, and ground terminals are not arranged adjacently to one another.

If the plurality of the input terminals on the electric contact substrate is arranged such that head driving voltage input terminals, logic system voltage input terminals, and ground terminals are not arranged adjacently to one another as stated above, the smoking can be prevented when the contact portion of the input terminal is short-circuited when ink is adhered to the surface of the electric contact substrate where the input terminals are formed.

In order to attain the above object, there is provided an ink jet recording apparatus comprising: a carriage having a plurality of terminals coming into contact with the input terminals of the ink jet recording head to be electrically connected to the input terminals in a state where the above-mentioned ink jet recording head is detachably mounted on the ink jet recording apparatus; and in which each of the recording element substrates of the ink jet recording head discharges a recording liquid in connection with scanning of the carriage to thereby make a record on a medium to be recorded.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures wherein.

DESCRIPTION OF THE PREFERRED EMBODIMENTS

Preferred embodiments of the present invention will now be described in further detail with reference to the accompanying drawings.

FIGS. 1A, 1B, 9A, 9B, 13 and 14 are views showing an ink jet recording head cartridge according to an embodiment, and FIGS. 2, 3, 8, 10 and 11 are views showing an ink jet recording head cartridge according to another embodiment. In these two embodiments, a black head portion and a color head portion are laterally reversed in position. These figures are views useful in explaining a head cartridge and an ink tank to which an ink jet recording head can suitably be applied, and the relationship between the head cartridge and the ink tank. The respective components will hereunder be described with reference to these figures.

Figure 1A:
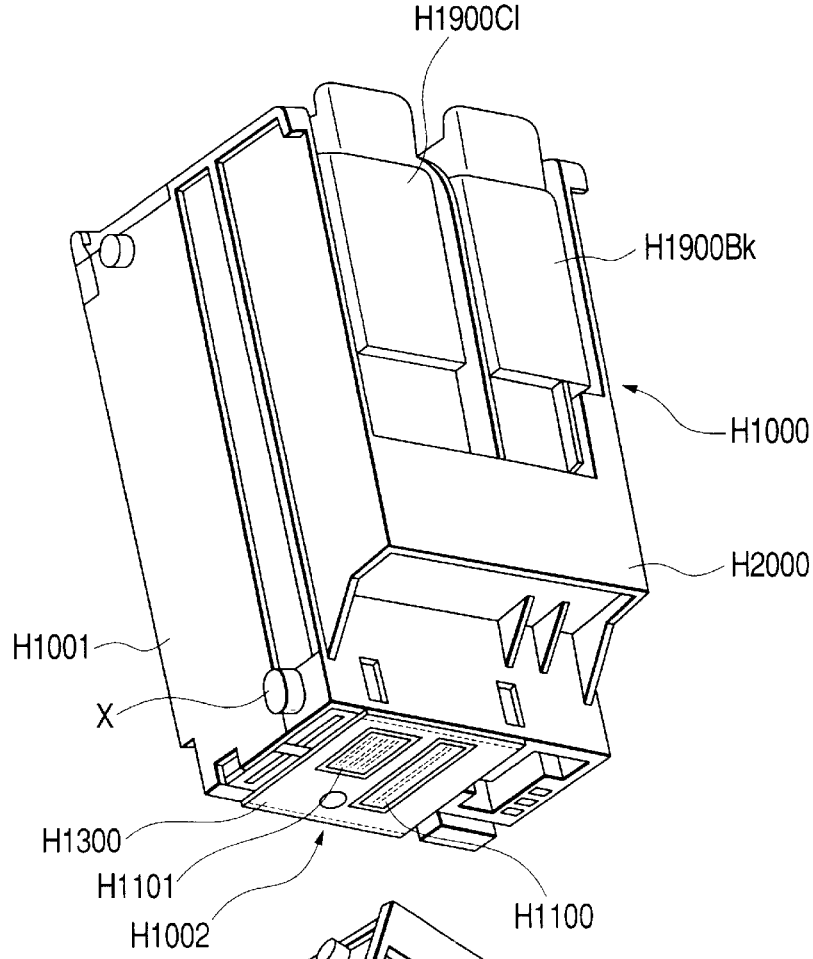
FIG. 1A is a perspective view showing a recording head cartridge according to an embodiment of the present invention.
Figure 1B:
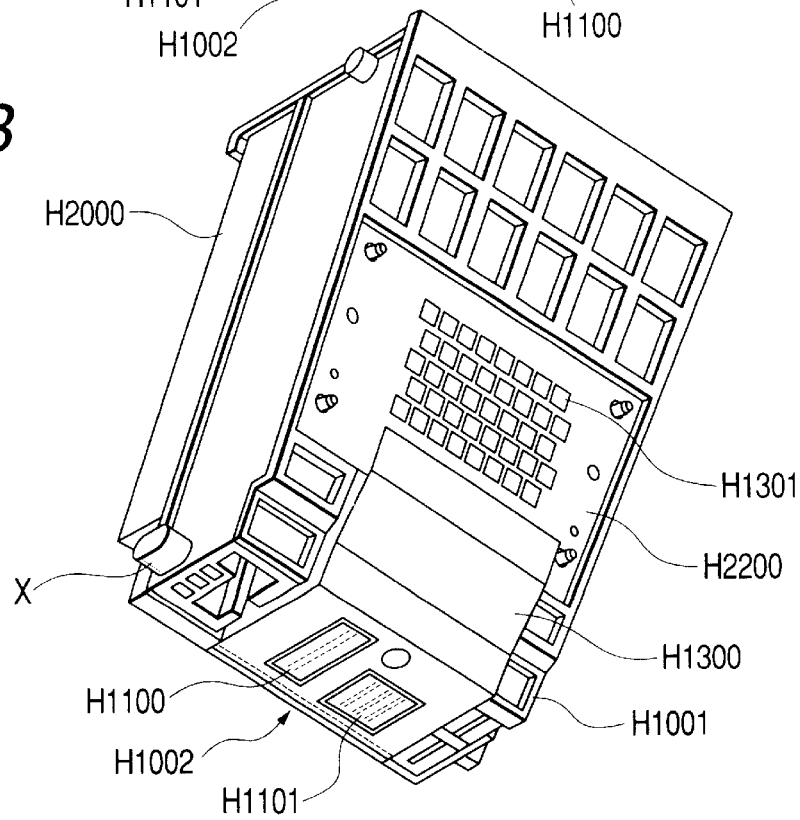
FIG. 1B is a perspective view showing the reverse side of the recording head cartridge in FIG. 1A.

FIGS. 1A and 1B show the positional relationship between a second recording element substrate H1101 for color recording and a first recording element substrate H1100 for black recording corresponding to FIG. 9 described below, and the relationship of 8 rows>5 rows in which the arrangement of external signal input terminals H1301 as a connector portion serving as an electric contact on an electric contact substrate 2200 whose width is wider than that of an electric wiring tape 1300 satisfies the relationship of m>n as described below.

The positional relationship in the head, i.e. the positions of the first recording element substrate H1100 and the second recording element substrate H1101 may be reversed, and thus, only common parts will now be described with reference to FIGS. 2 to 8. An ink tank mounted in the cartridge in FIGS. 1A and 1B represents a color ink tank H1900C1 containing three-color ink in yellow, magenta and cyan, and an ink tank H1900BK containing black color ink. Thus, the embodiment shown in FIGS. 1A and 1B and the embodiment shown in FIGS. 2 to 8 are similar in the number of connecting portions (pads) and the positional relationship m>n thereof, but they are different in wirings.

Figure 8:
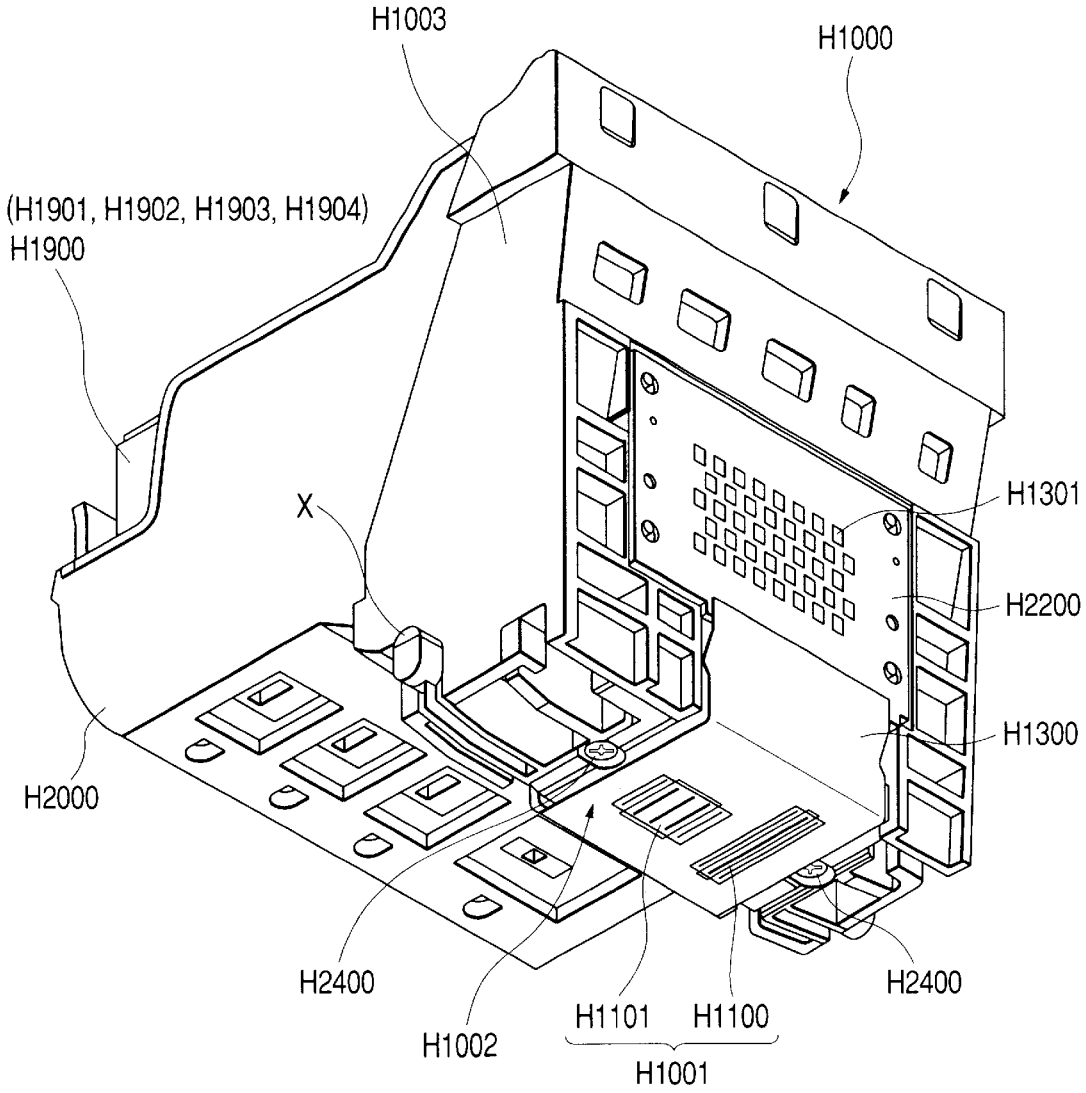
FIG. 8 is a perspective view showing a recording head that is constructed by integrating the ink supply unit and the recording element unit with a tank holder.

As is apparent from the perspective views of FIGS. 1A, 1B and 8, a recording head (ink jet recording head) H1001 of the present invention is one component of a recording head cartridge H1000. The recording head cartridge H1000 is comprised of a recording head H1001 and an ink tank that is detachably attached to the recording head H1001. In the embodiment shown in FIG. 1, the color ink tank H1900cl containing three-color ink and the ink tank H1900BK containing only black ink are detachably mounted in the recording head H1001 as stated above. In the embodiment shown in FIG. 8, a black ink tank H1901, a cyan ink tank H1902, a magenta ink tank H1903 and a yellow ink tank H1904 are detachably mounted in the recording head H1001.

The recording head cartridge H1000 is fixedly supported by a positioning means and an electric contact of a carriage (not shown) installed in the body of the ink jet recording apparatus by means of a positioning portion X located at the side of the cartridge where the recording head H1001 is provided. The recording head cartridge H1000 is detachable from the carriage. The black ink tank H1901 is used to contain black ink, the cyan ink tank H1902 is used to contain cyan ink, the magenta ink tank H1903 is used to contain magenta ink, and the yellow ink tank H1904 is used to contain yellow tank. In the embodiment shown in FIG. 8, the ink tanks respectively containing black, cyan, magenta and yellow ink are mounted in the recording head H1001. Since the respective ink tanks are detachable from the recording head H1001 and are exchangeable as stated above, it is possible to exchange only an ink tank that requires exchange of ink. Thus, this reduces the running cost for printing in the ink jet recording apparatus.

Next, the components of the recording head H1001 will now be described in order in further detail.

(1) Recording Head

The recording head H1001 is a bubble jet side-shooter type recording head that performs recording by electrothermal converting elements (recording elements) that generate thermal energy for causing film boiling to ink according to an electric signal.

Figure 2:
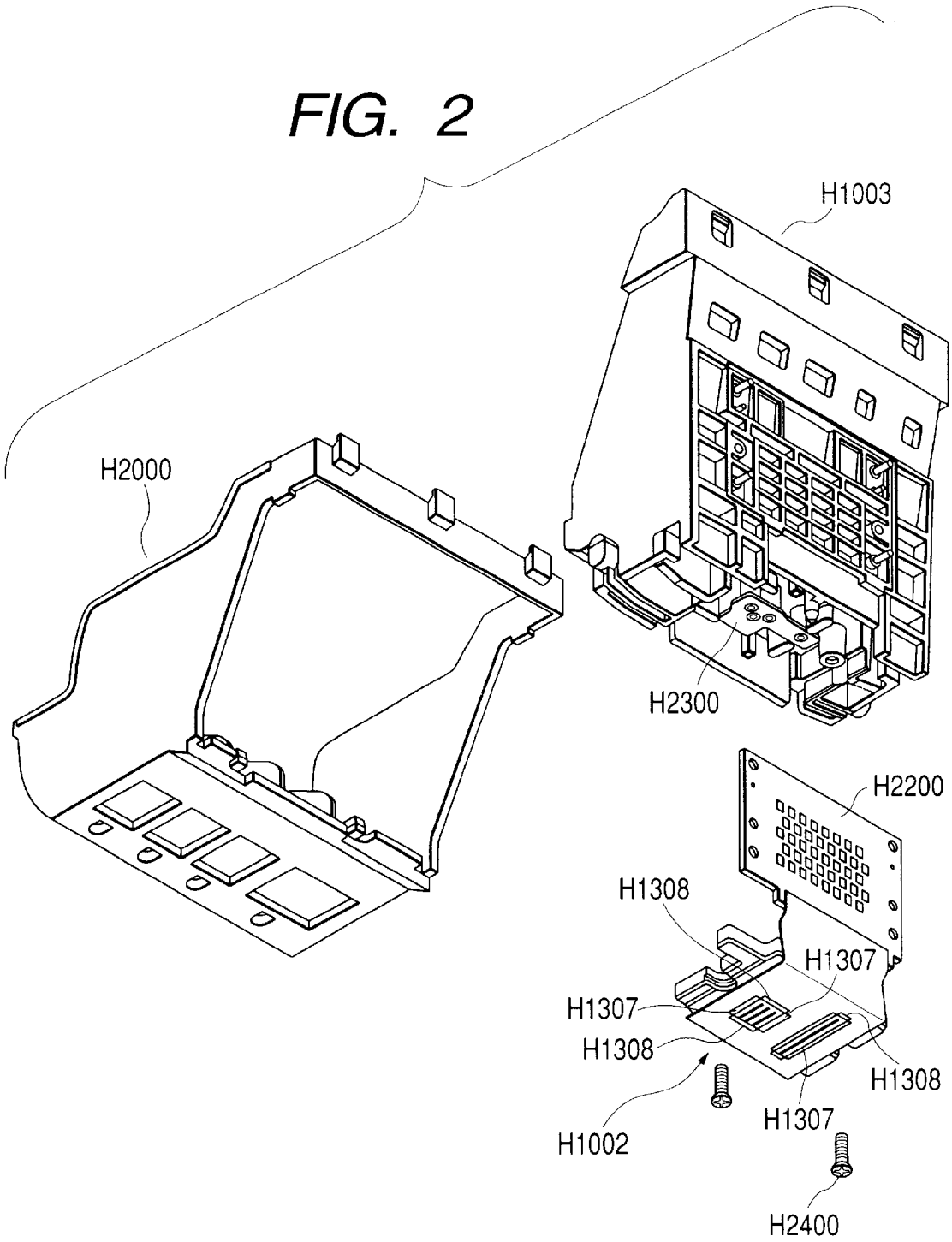
FIG. 2 is an exploded perspective view showing a recording head cartridge in FIG. 8.

As shown in the exploded perspective view of FIG. 2, the recording head H1001 is comprised of a recording element unit H1002, an ink supply unit H1003, and a tank holder H2000.

Figure 3:
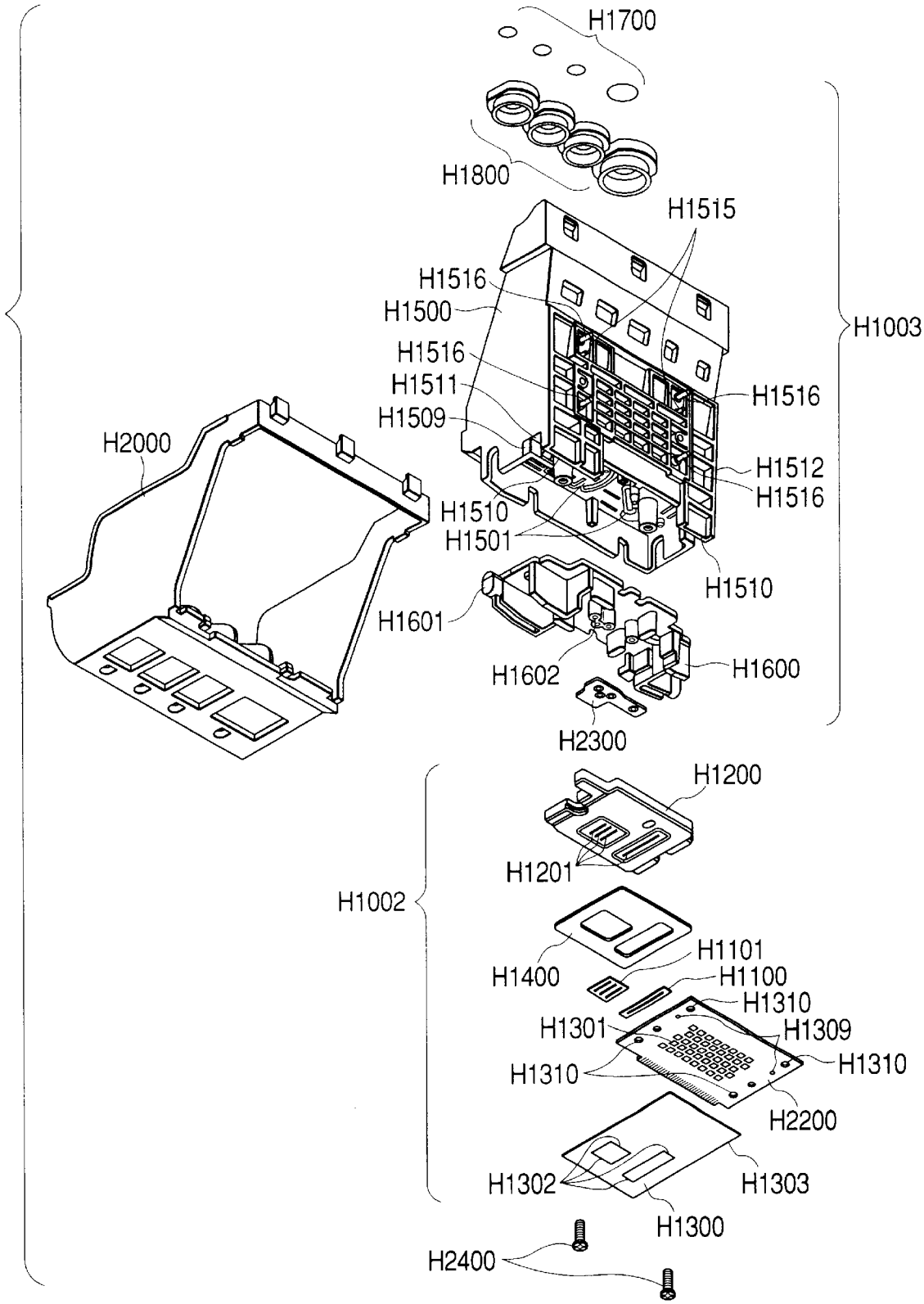
FIG. 3 is an exploded perspective view showing an ink supply unit and a recording element unit.

As shown in the exploded perspective view of FIG. 3, the recording element unit H1002 is comprised of the first recording element substrate H1100, the second recording element substrate H1101, a first plate H1200, the electric wiring tape (flexible wiring substrate) H1300, the electric contact substrate H2200, and a second plate H1400. The ink supply unit H1003 is comprised of an ink supply member H1500 serving as a supporting member for supporting the recording element unit H1002, a flow path forming member H1600, a joint rubber H2300, a filter H1700, and a seal rubber H1800.

(1-1) Recording Element Unit

Figure 4:
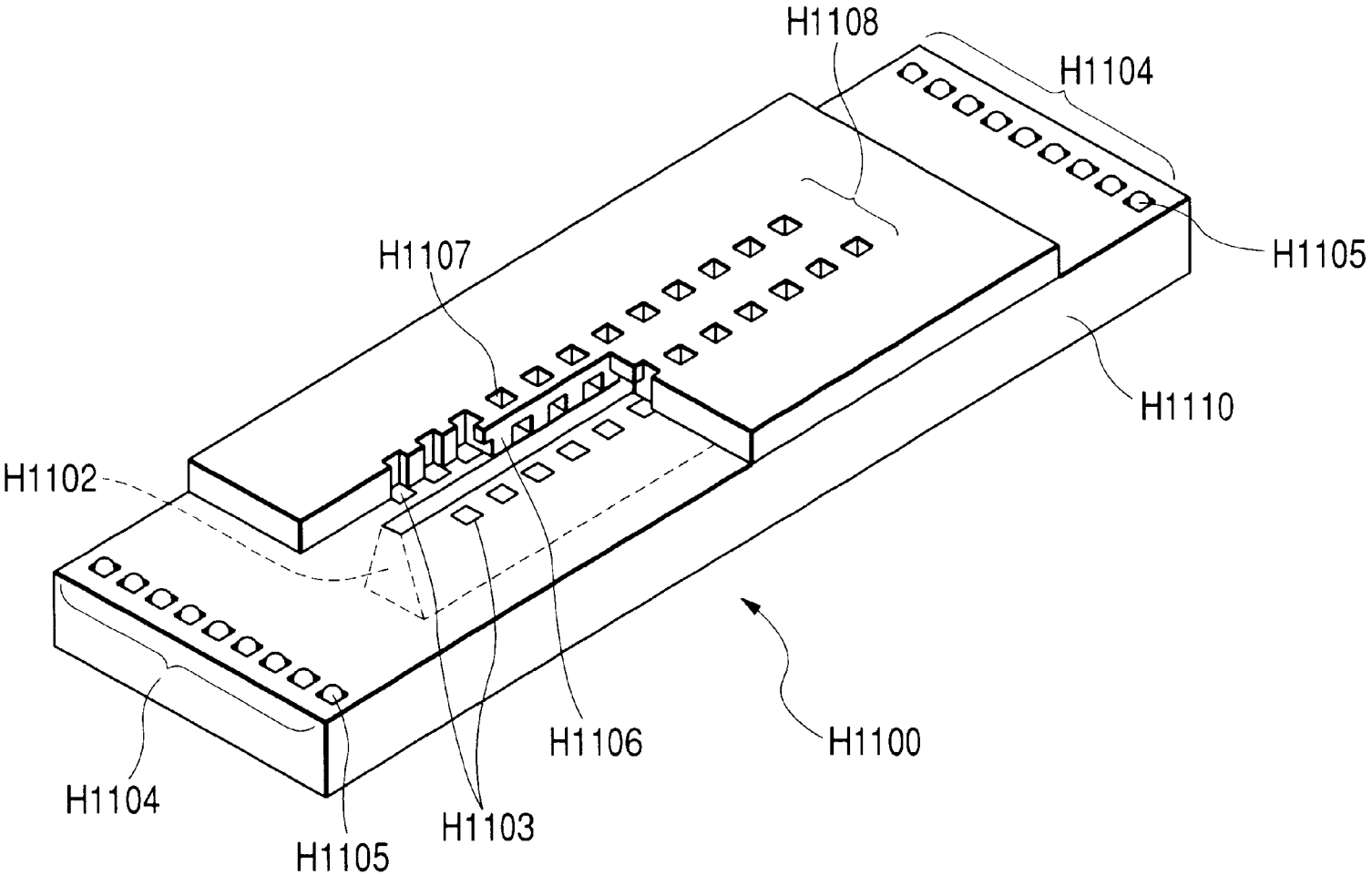
FIG. 4 is a partially broken-out perspective view showing a first recording element substrate in FIG. 3.

FIG. 4 is a partially exploded perspective view useful in explaining the structure of the fist recording element substrate H1100.

In the first recording element substrate H1100, an ink supply port H1102 comprised of a longitudinal grooved hole is formed as an ink flow path on an Si substrate H1110 having a thickness of 0.5 to 1 mm by anisotropic etching or sandblasting utilizing the crystal orientation of Si, and the electrothermal converting elements (recording elements) H1103 are arranged row by row in a zigzag manner at both sides of the ink supply port H1102, and the electrothermal converting elements H1103 and an electric wiring, not shown, such as Al for supplying power to the electrothermal converting elements H1103 are formed by a film forming method. Further, electrode portions H1104 are arranged on both sides of the electrothermal converting elements H1103, and bumps H1105 such as Au are formed in the electrode portions H1104. On an Si substrate H1100, ink flow path walls H1106 and discharge ports H1107 for forming ink flow paths corresponding to the electrothermal converting elements H1103 are formed of a resin material by photolithography to thus constitute a discharge port group H1108.

Ink supplied through the ink supply port H1102 is discharged through the discharge ports H1107, which are positioned to face the electrothermal converting elements H1103, due to bubble generated by the electrothermal converting elements H1103.

Figure 5:
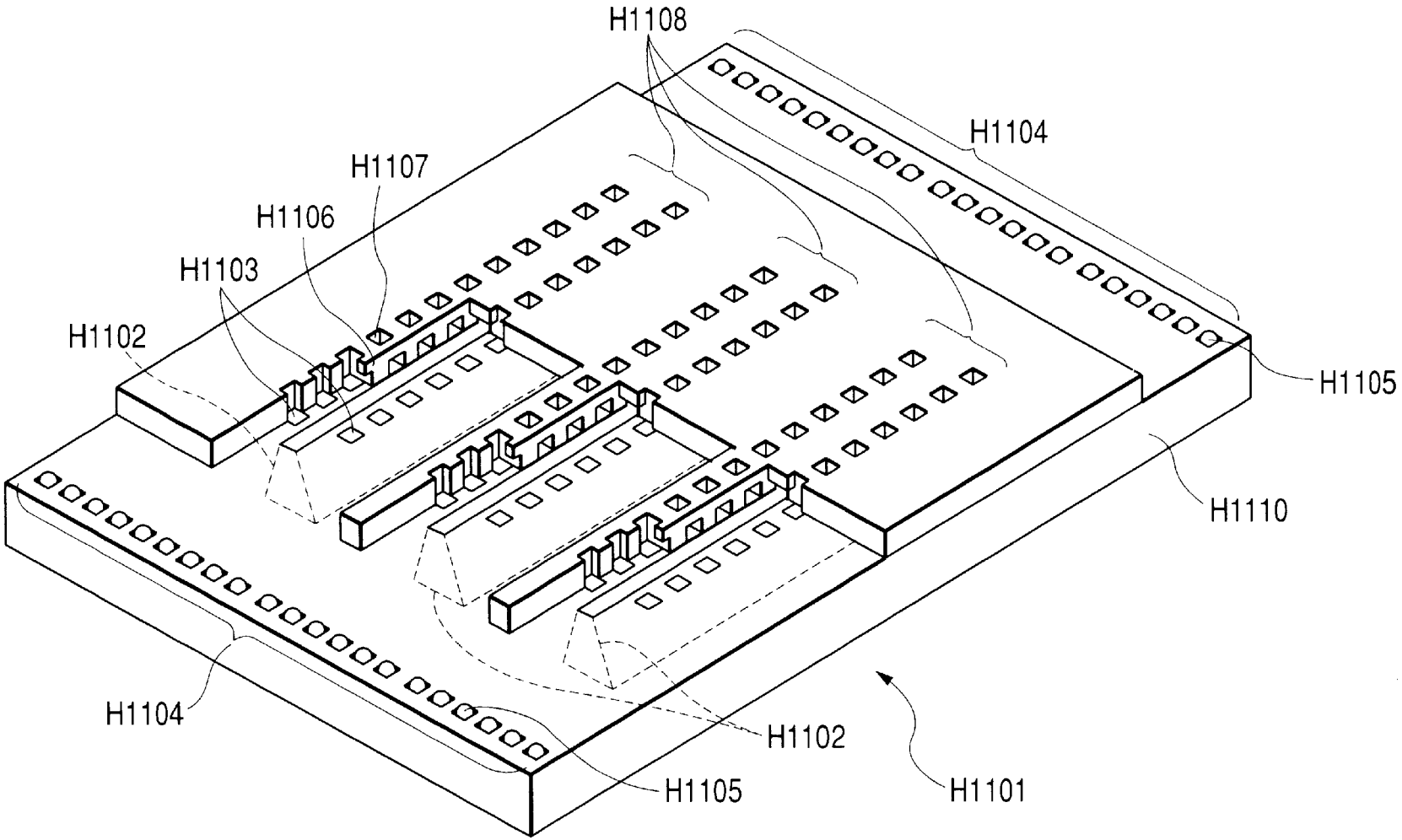
FIG. 5 is a partially broken-out perspective view showing a second recording element substrate in FIG. 3.

FIG. 5 is a partially exploded perspective view useful in explaining the structure of the second recording element substrate H1101.

The second recording element substrate H1101 is a recording element substrate for use in discharging ink in the following three colors: cyan, magenta and yellow. Three ink supply ports H1102 are formed in parallel on the second recording element substrate H1101, and the electrothermal converting elements H1103 and the discharge ports H1107 are formed at both sides of the respective ink supply ports. As is the case with the first recording element substrate H1100, the ink supply port H1102, the electrothermal converting elements H1103, the electric wiring, the electrode portions H1104, and the like are formed on the Si substrate H1110, and the ink flow paths and the discharge ports H1107 are formed of a resin material thereon by photolithography.

As is the case with the first recording element substrate H1100, bumps H1105 such as Au are formed in the electrode portions H1104 so as to supply power to the electric wiring.

There will now be described the first plate H1200.

The first plate H1200 is made of an alumina ($Al_2O_3$) material having a thickness of 0.5 to 10 mm. Note that the material for the first plate H1200 should not be restricted to alumina. The first plate H1200 may be made of a material having the same linear expansion coefficient as that of the material for the recording element substrate H1100 and having a linear conductivity equal to or larger than that of the material for the recording element substrate H1100. The material for the first plate H1200 may be any one of the following: silicon (Si), aluminium nitride (AlN), zirconia, silicon nitride ($Si_3N_4$), silicon carbide (SiC), molybdenum (Mo), and tungsten (W). An ink supply port H1201 for supplying black ink to the first recording element substrate H1100 and an ink supply port H1201 for supplying cyan, magenta and yellow ink to the second recording element substrate H1101 are formed in the first plate H1200. The respective ink supply ports H1102 of the first recording element substrate H1100 and the second recording element substrate H1101 correspond to the ink supply ports H1201 of the first plate H1200, the first recording element substrate H1100 and the second recording element substrate H1101 are adhered and fixed to the first plate H1200 with a high positional accuracy. Preferably, a first adhesive agent used for adhesion has a low viscosity, is hardened at a low temperature within a short time, keeps a relatively high hardness after hardening, and is proof against ink. The first adhesive agent is, for example, a thermosetting adhesive agent composed mainly of epoxy resin, and an adhesive layer thereof preferably has a thickness of 50$\mu$m or less.

The electric wiring tape H1300 is used to apply an electric signal for discharging ink to the first recording element substrate H1100 and the second recording element substrate H1101. The electric wiring tape H1300 is composed of a plurality of openings for incorporating the respective recording element substrates therein, electrode terminals H1302 corresponding to the electrode portions H1104 of the respective recording element substrates, an electrode terminal portion H1303 for electric connection with the electric contact substrate H2200 having the external signal input terminals H1301 for receiving electric signals from the body of the apparatus. The electrode terminals H1302 and the electrode terminal portions H1303 are connected to one another in continuous copper-foil wiring patterns. Therefore, the electric wiring tape H1300 is connected to the first recording element substrate H1100, the second recording element substrate H1101 and the electric contact substrate H2200 so that the external signal input terminals H1301 corresponding to the respective electrothermal converting elements H1103 can be electrically connected to the respective electrothermal converting elements H1103 of the first recording element substrate H1100 and the second recording element substrate H1101.

To electrically connect the electric wiring tape H1300 with the first recording element substrate H1100 and the second recording element substrate H1101, for example, the bumps H1105 in the electrode portions H1104 of the first recording element substrate H1100 may be electrically bonded to the electrode terminals H1302 of the electric wiring tape H1300 corresponding to the electrode portions H1104 of the first recording element substrate H1100 by thermal ultrasonic compression bonding, and similarly, the bumps H1105 in the electrode portions H1104 of the second recording element substrate H1101 my be electrically bonded to the electrode terminals H1302 of the electric wiring tape H1300 corresponding to the electrode portions H1104 of the second recording element substrate H1101 by thermal ultrasonic compression bonding.

The second plate H1400 is, for example, a plate member having a thickness of 0.5 to 1 mm, and is made of metallic material like ceramic such as alumina ($Al_2O_3$), Al, and SUS. The second plate H1400 is shaped to have openings larger than the respective outside dimensions of the first recording element substrate H1100 and the second recording element substrate H1101 adhered and fixed to the first plate H1200. The second plate H1400 is adhered to the first plate H1200 by a second adhesive agent so that the first recording element substrate H1100, the second recording element substrate H1101 and the electric wiring tape H1300 can be two-dimensionally and electrically connected together. The reverse side of the electric wiring tape H1300 is adhered to and fixed to the second plate H1400 by a third adhesive agent.

Electrically connecting portions among the first recording element substrate H1100 and the second recording element substrate H1101 and the electric wiring tape H1300 are sealed by first sealing agent H1307 and second sealing agent H1308 as shown in FIG. 2 so that the electrically connecting portions can be protected from corrosion and external impact. The first sealing agent H1307 seals the reverse side of a connecting portion between the electrode terminals 1302 of the electric wiring tape H1300 and the bumps H1105 of the recording element substrates and the peripheries of the recording element substrates, and the second sealing agent H1308 seals the surface of the above-mentioned connecting portion.

Further, the electric contact substrate H2200 having the external signal input terminals H1301 for receiving electric signals from the apparatus body is electrically connected to the end of the electric wiring tape H1300 by thermo-compression bonding using anisotropic conductive film or the like.

The electric wiring tape H1300 is bent at one side of the first plate H1200, and is adhered to the side of the first plate H1200 by the third adhesive agent. The third adhesive agent is, for example, a thermosetting adhesive agent having a thickness of 10 to 100 $\mu$m mainly composed of an epoxy resin.

(1-2) Electric Contact Substrate

As shown in FIGS. 2 and 3, the width of the electric contact substrate H2200 is wider than that of the electric wiring tape H1300 in the lateral direction perpendicular to the longitudinal direction parallel to a direction in which the electric contact substrate H2200 and the electric wiring tape H1300 are arranged. According to the present invention, the direction in which the electric contact substrate H2200 and the electric wiring tape H1300 are arranged, i.e., the arrangement direction of the electric contact substrate H2200 and the electric wiring tape H1300 is assumed to be the longitudinal direction, and the direction vertical to the longitudinal direction and parallel to the surface of the electric contact substrate H2200 is assumed to be the lateral direction.

The use of the electric wiring tape H1300 and the electric contact substrate H2200 whose width is wider than that of the electric wiring tape H1300 decreases the number of the external signal input terminals H1301 serving as contact pads, and prevents the contact pressure applied by the contact between the terminals on the side of the recording apparatus body and the external signal input terminals H1301 in the electric connection with the recording apparatus from varying according to the positions of the pads and terminals, without making oblong the pad arrangement of the external signal input terminals H1301. As a result, this reduces the poor contact between the external signal input terminals H1301 of the electric contact substrate H2200 and the terminals of the carriage mounted in the recording apparatus body.

Referring next to FIGS. 9A and 9B to 11, 13 and 14, there will be described the structure of the electric contact substrate H2200.

Figures 9A, 9B:
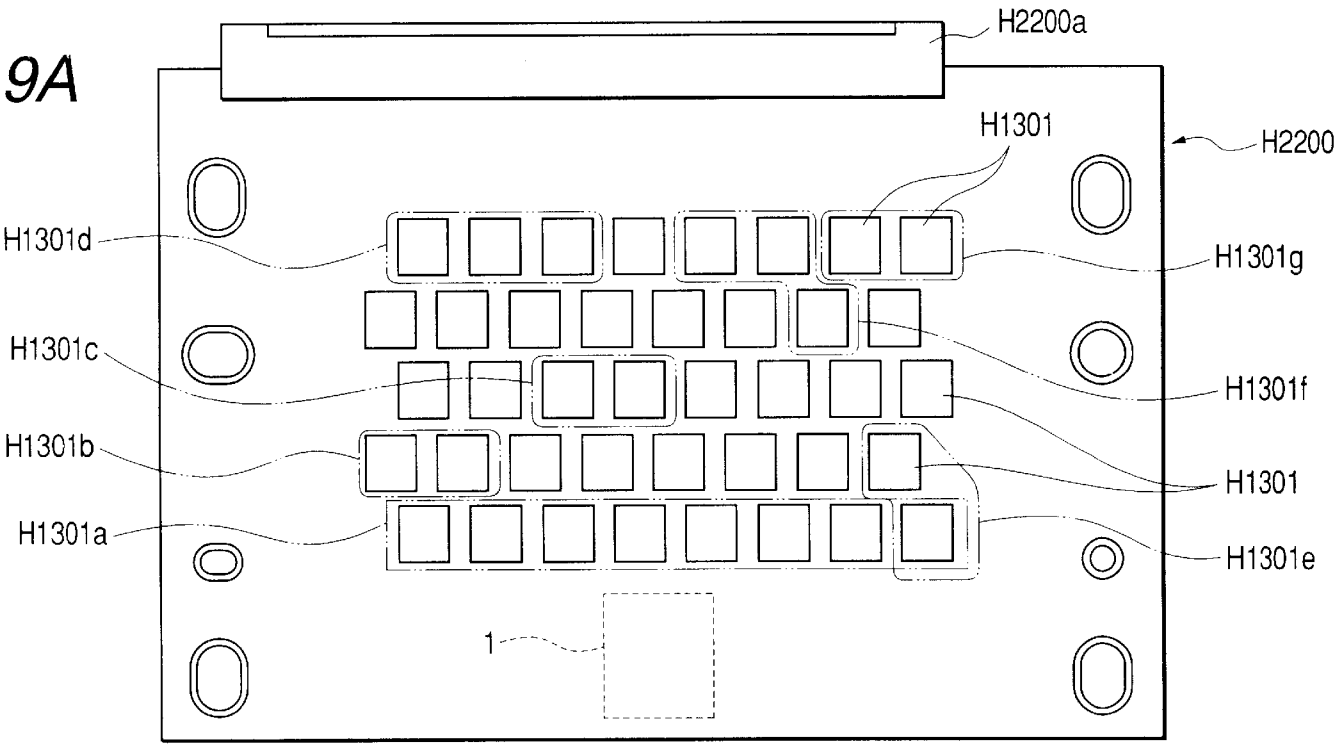
FIG. 9A is a plan view showing a layout of pads on an electric contact substrate.
FIG. 9B is a view showing a wiring pattern at an electrode terminal section that is positioned at the end of an electric wiring tape for electric connection with an electric contact substrate.
Figure 10:
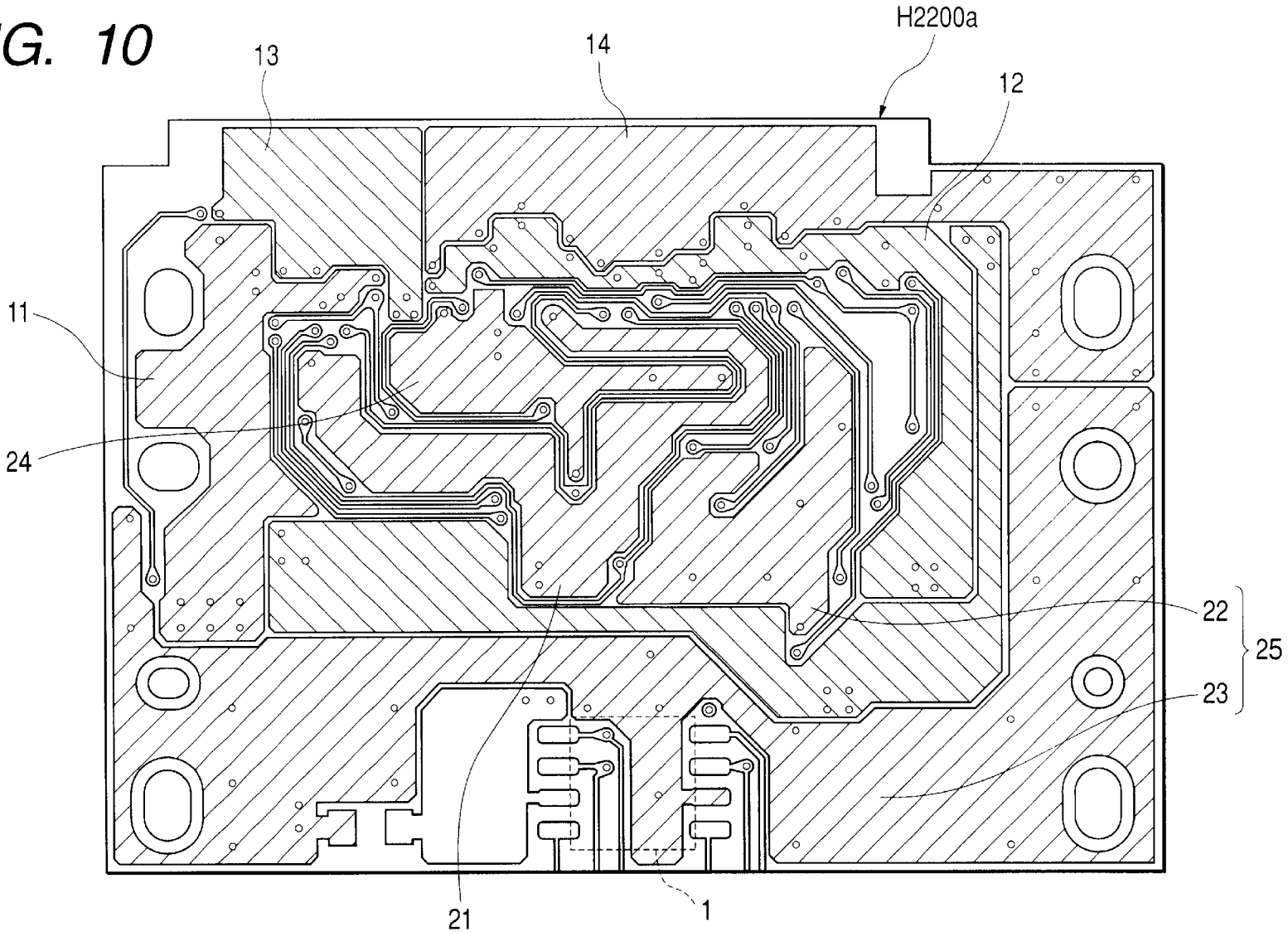
FIG. 10 is a plan view showing conductor patterns on a surface of the electric contact substrate that is opposite to the surface on which the pads are formed, i.e., the reverse side of the electric contact substrate.
Figure 11:
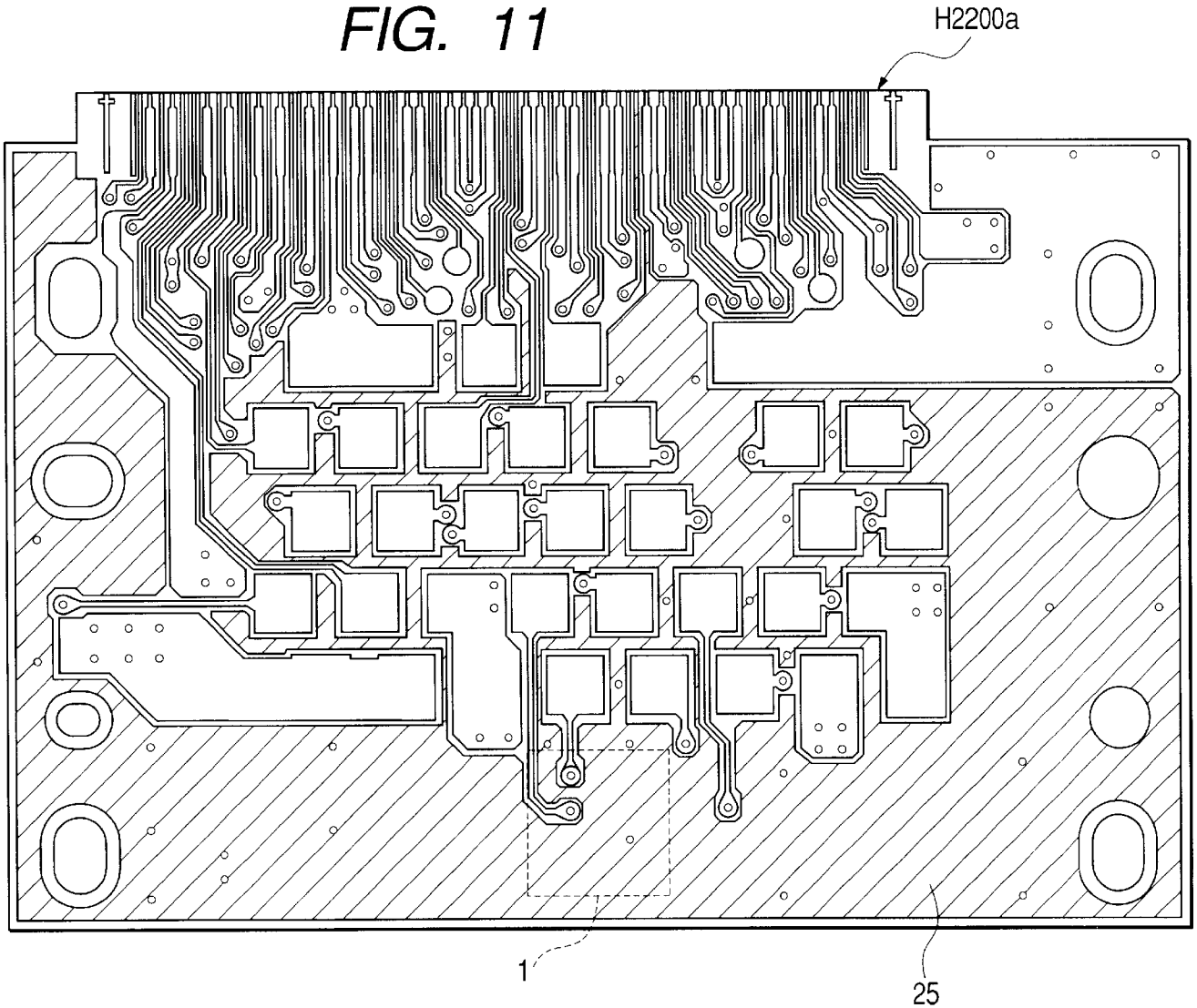
FIG. 11 is a plan view showing conductor patterns in an underlayer of a resist layer that partially covers the surface of the electric contact substrate on which the pads are formed.

FIG. 9A is a plan view showing the layout of pads on the electric contact substrate H2200 mounted in the ink jet recording head according to the present embodiment as is the case with the embodiments shown in FIGS. 2 to 8. FIG. 9B is a view showing a wiring pattern of the electrode terminal portion H1303 that is located at the end of the electric wiring tape H1300 and is used for electric connection with the electric contact substrate H2200 having the external signal input terminals H1301 for receiving electric signals from the recording apparatus body. FIG. 10 is a plan view showing conductor patterns at one side of the electric contact substrate H2200 opposite to the side where the pads are provided, i.e., at the reverse side of the electric contact substrate H2200. FIG. 10 is a perspective view of the substrate taken from the pad side of the electric contact substrate H2200. FIG. 11 is a plan view showing conductor patterns of an underlayer of a resist layer that partially covers surface of the electric contact substrate H2200 where the pads are arranged.

According to the present embodiment, the electric contact substrate H2200 is shaped like a substantially rectangle as shown in FIG. 9A, and a connecting portion H2200*a*, to which the electric contact wiring tape H1300 whose width is relatively narrower than the electric contact substrate H2200 is connected, is provided at a part of the long side of the electric contact substrate H2200. A plurality of the external signal input terminals H1301 is arranged in the lateral and longitudinal directions on the surface of the electric contact substrate H2200.

Eight external signal input terminals H1301 are arranged on the surface of the electric contact substrate H2200 in the lateral direction parallel to the longer side of the electric contact substrate H2200, i.e., the lateral direction perpendicular to the longitudinal direction parallel to the direction in which the electric contact substrate H2200 and the electric wiring tape H1301 are arranged. Five rows of eight external signal input terminals H1300, which extend in the lateral direction, are arranged on the electric contact substrate H2200 in the longitudinal direction. Thus, if the maximum number of external signal input terminals H1301 in the lateral direction is assumed to be m and the maximum number of external signal input terminals H1301 in the longitudinal direction is assumed to be n, the maximum number m of external signal input terminals H1301 in the lateral direction is 8 and the maximum number n of external signal input terminals H1300 in the longitudinal direction is 5. This satisfies the relationship of m>n. Preferably, n is not greater than 5. According to the present embodiment, the rows of the maximum number m of external signal input terminals H1301 arranged in the lateral direction are arranged in the longitudinal direction in the same number as the maximum number n of external signal input terminals H1301 in the longitudinal direction. Therefore, the external signal input terminals H1301 are arranged in the form of a rectangle on the electric contact substrate H2200.

In the case where the external signal input terminals H1301 are arranged in the form of a rectangle as mentioned above, the positions of the farthest input terminals from the first recording element substrate H1100, the second recording element substrate H1101 and the electric wiring tape H1300 among the plurality of the external signal input terminals H1301 on the electric contact substrate H2200 can be closer to those recording element substrates than in the case where the external signal input terminals H1301 are arranged in the form of an oblong. If the ink jet recording head is mounted in the carriage of the recording apparatus body or the like, the side of the ink jet recording head where the recording element substrates are provided is positioned and fixed. Thus, if the external signal input terminals H1301 are arranged in the form of a rectangle on the electric contact substrate H2200 so that the farthest input terminals from the recording element substrates among the input terminals on the electric contact substrate can be as close as possible to the recording element substrates, the contact pressure can be prevented from varying according to the positions of the terminals when the external signal input terminals H1301 and the terminals of the carriage are brought into contact with one another in electric connection thereof. This significantly reduces the unfavorable contact between the external signal input terminals H1301 on the electric contact substrate H2200 and the terminals in the recording apparatus body in the electric connection, and realizes the compact and inexpensive ink jet recording head.

According to the present embodiment, eight external signal input terminals H1301 are arranged in the lateral direction, and five rows of external signal input terminals H1301 extending in the lateral direction are arranged in the longitudinal direction, there is no intention to limit the number of external signal input terminals H1301 in the lateral direction and the number of rows in the longitudinal direction to it. It is possible to provide any number of external signal input terminals H1301 insofar as the external signal input terminals H1301 can be arranged in the form of a rectangle on the electric contact substrate H2200, and the external signal input terminals H1301 may be arranged in any manner.

Further, in the ink jet recording head according to the present embodiment, a memory element 1 is mounted at the reverse side of the end portion of the electric contact substrate H2200 at one side opposite to the side where the connecting portion H2200*a* is formed. The memory element 1 is arranged at a longer distance from the connecting portion H2200*a* than the respective external signal input terminals H1301. Since the memory element 1 is arranged at the reverse side of the electric contact substrate H2200 and is located at a longer distance from the recording element substrate than the external signal input terminals H1301 as stated above, it is possible to prevent the poor contact in the electric connection between the terminals of the carriage and the external signal input terminals H1301 and to enable the recording head to come into contact with the carriage in a preferable manner. Thus, the memory element 1 is preferably located at the longest possible distance from the recording element substrate on the electric contact substrate H2200. According to the present embodiment, an EEPROM (Electrically Erasable Programmable Read-Only Memory) is used as the memory element 1.

There will now be described the layout of the external signal input terminals H1301 on the electric contact substrate H2200.

In the ink jet recording head according to the present embodiment, among the external signal input terminals H1301 on the electric contact substrate H2200, one row of the external signal input terminals H1301 by the side of the memory element 1 is a black side input terminal row H1301*a* as shown in FIG. 9A. The respective terminals in the black side input terminal row H1301*a* are electrically connected to the black recording element substrate (substrate H1100) for use in discharging a black recording liquid. Thus, among the plurality of the external signal input terminals H1301, only the terminals electrically connected to the first recording element substrate H1100 are arranged in an outermost row at the opposite side of the electric wiring tape H1300.

As stated above, the black side contact pads are arranged in one row by the side of the memory element 1 on the electric contact substrate H2200. Therefore, only erasing one row by the side of the memory element 1 among the external signal input terminals H1301 on the electric contact substrate H2200 enables the manufacture of a head cartridge that is not provided with a black recording head. Thus, this eliminates the need for redesigning the electric contact substrate H2200 in the manufacture of such a head cartridge, and enables the proper arrangement of the pads according to the structure of each head.

There will now be described the layout of the external signal input terminals H1301. The first and second external signal input terminals H1301 from the left in FIG. 9A in the second row from the memory element 1 are color side power source terminals H1301*b* serving as head driving voltage input terminals for the second recording element substrate H1101. The third and fourth external signal input terminals H1301 from the left in FIG. 9A in the third row from the memory element 1 are logic system power source terminals H1301*c* serving as logic system voltage input terminals. Further, the first, second and third external signal input terminals H1301 from the left in FIG. 9A in the first row from the connecting portion H2200*a* are color side GND (ground) terminals H1301*d* for the second recording element substrate H1101. The fifth and sixth external signal input terminals H1301 from the left in FIG. 9A in the first row from the connecting portion H2200*a*, and the seventh external signal input terminal H1301 from the left in the second row from the connecting portion H2200*a* are logic system GND terminals H1301*f*. Further, the seventh and eighths external signal input terminals H1301 from the left in FIG. 9A in the first row from the connecting portion H2200*a* are black side GND terminals H130l*g* for the first recording element substrate H1100. The eighth external signal input terminals H1301 from the left in FIG. 9A in the second row from the memory element 1, and the eighth external signal input terminals H1301 from the left in the first row from the memory element 1 are black side power source terminals H1301*e* serving as head driving voltage input terminals for the first recording element substrate H1100.

Figure 13:
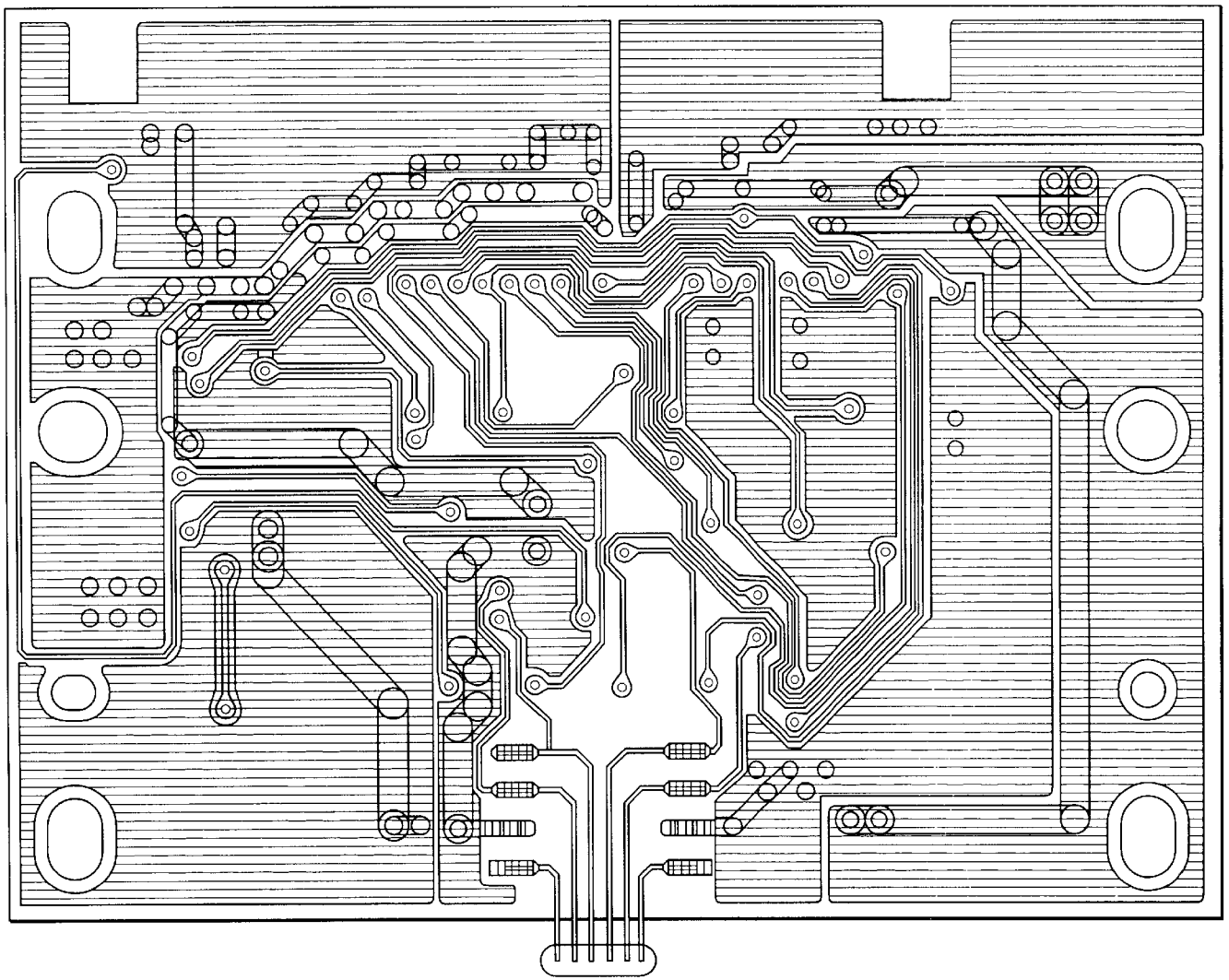
FIG. 13 is a view showing a structure of the electric contact substrate.
Figure 14:
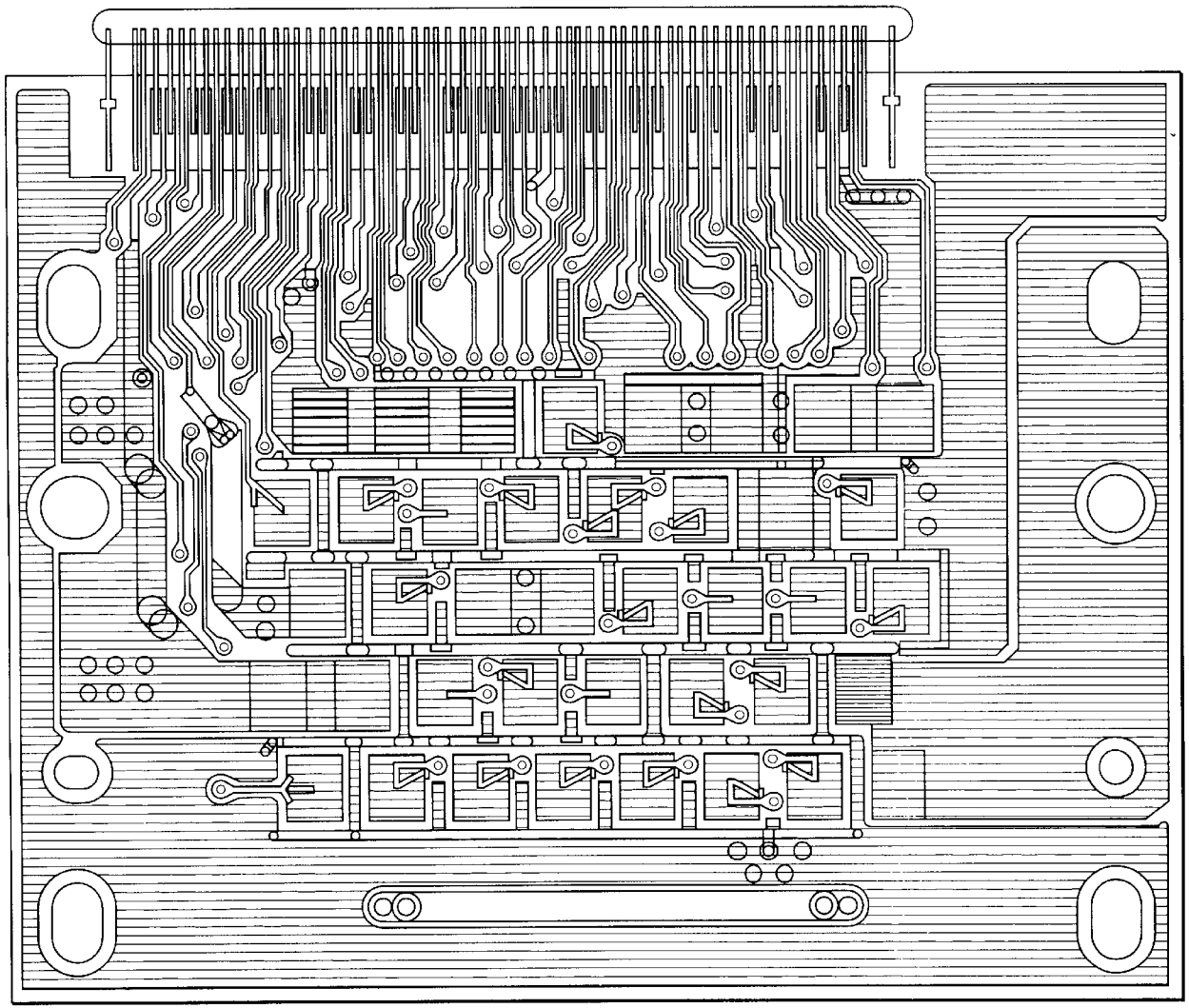
FIG. 14 is a view showing the structure of the electric contact substrate.

In the above-described pad layout of the external signal input terminals H1301, the head driving voltage input terminals including the color side power source terminals H1301*b* and the black side power source terminals H1301*e*, the logic system power source terminals H1301*c*, and the respective ground terminals thereof are arranged such that they are not adjacent to one another. Since the external signal input terminals H1301 are arranged such that the power source terminals and the GND terminals are not adjacent to one another as stated above, the smoking can be prevented when the contact portion is short-circuited when ink is adhered to the surface of the electric contact substrate H2200 where the external signal input terminals H1301 are formed, i.e., the pad portion of the recording head for use in an ink jet printer as shown in FIGS. 13 and 14. The details thereof will be described with reference to FIGS. 10 and 11.

As shown in FIG. 10, in a wiring layer at the reverse side of the electric contact substrate H2200, a black side power source pattern 11 for the first recording element substrate H1100, a color side power source pattern 12 for the second recording element substrate H1101, a black side GND pattern 13 for the first recording element substrate H1100, a color GND pattern 14 for the second recording element substrate H1101, a logic system power source pattern 21, and logic system GND patterns 22, 23 and 24 are formed at predetermined respective positions. According to the respective patterns, these conductor patterns are formed in the largest possible area in the wiring layer in order to decrease noise. In the electric contact substrate H2200 according to the present embodiment, a logic system GND pattern is divided into the logic system GND patterns 22, 23 and 24 correspondingly to the first recording element substrate H1100 and the second recording element substrate H1101. The noise can be decreased by dividing the logic system GND pattern correspondingly to the respective recording element substrates in the electric contact substrate H2200 in this manner. The logic system GND patterns 22, 23 and 24 are electrically connected to one ground in a circuit of the recording apparatus body, and they are electrically connected to one another through conductors in the recording apparatus body.

As shown in FIG. 11, the conductor patterns in the underlayer of the resist layer that partially covers the surface of the external signal input terminals H1301 on the electric contact substrates H2200 are composed of conductor patterns constituting the respective external signal input terminals H1301 and a logic GND pattern 25. The logic system GND pattern 25 is formed in the largest possible area around the patterns constituting the external signal input terminals H1301 and the like in order to decrease noise.

(1-3) Ink Supply Unit

The ink supply member H1500 is formed of a resin or the like. Preferably, a resin material in which a glass filler of 5 to 40% is mixed is used in order to improve the formal rigidity.

Figure 6:
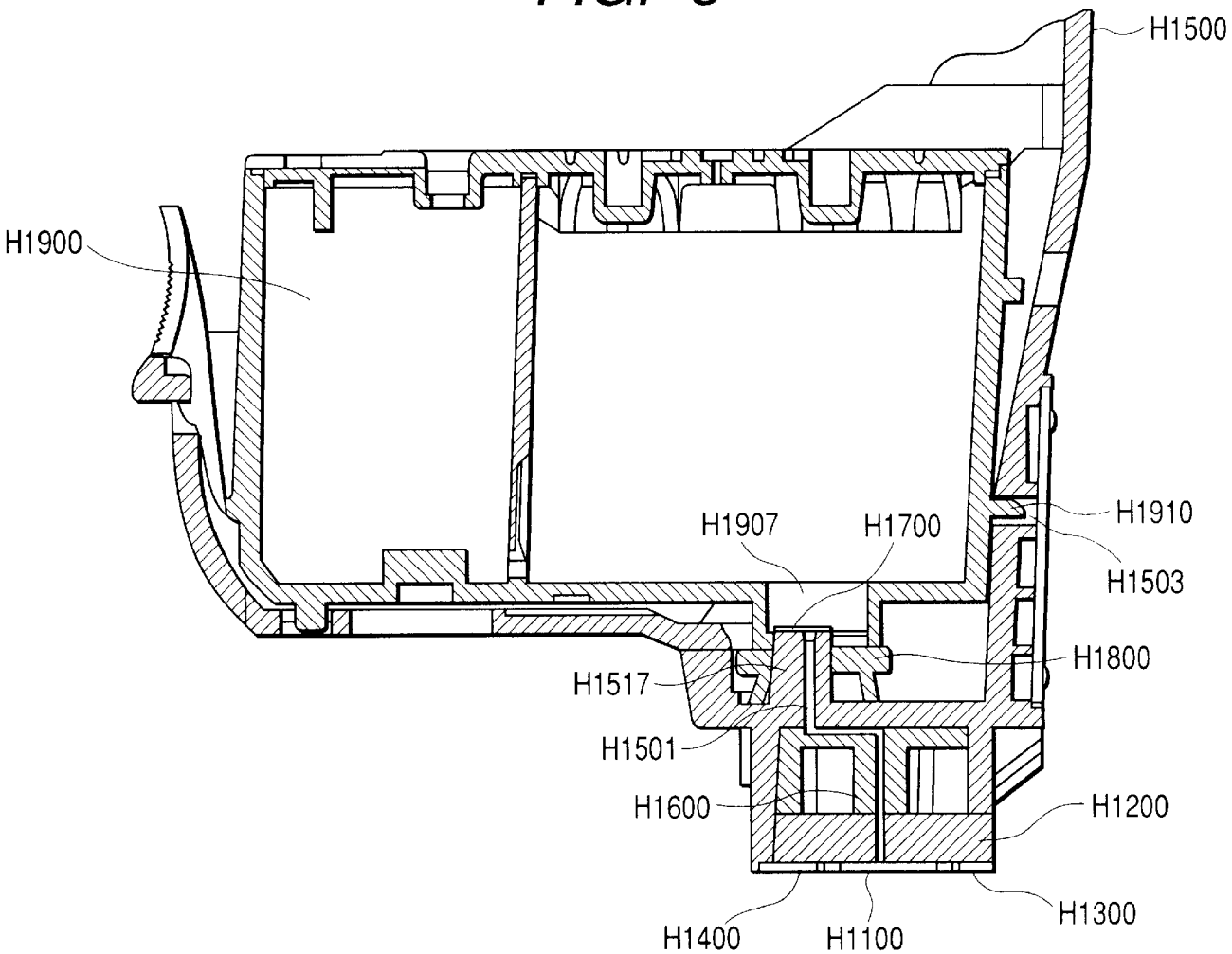
FIG. 6 is a side sectional view showing the recording head cartridge in FIG. 1.

As shown in FIGS. 3 and 6, the ink supply member H1500 is one component of the ink supply unit H1003 for use in supplying ink from the ink tank H1900 to the recording element unit H1002. The flow path forming member 1600 is deposited on the ink supply member H1500 by ultrasonic waves to thus form an ink flow path H1501. The filter H1700 is deposited on a joint H1517 connected with the ink tank H1900 so as to prevent the entry of dust from the outside. Further, the seal rubber H1800 is mounted in the ink supply member H1500 so as to prevent the evaporation of ink from the joint H1517.

The ink supply member H1500 also has a function of holding the detachable ink tank H1900, and accordingly, it has a first hole H1503 that is engaged with a second pawl H1910 of the ink tank H1900. The ink supply member H1500 also has an apparatus guide H1601 for guiding the recording head cartridge H1000 to the carriage mounting position of the ink jet recording apparatus body, an engagement portion for mounting and fixing the recording head cartridge H1000 on the carriage by a head set lever, an abutment portion H1509 in a direction X (carriage scanning direction) for positioning the recording head cartridge H1000 at a predetermined mounting position of the carriage, an abutment portion H1510 in a direction Y (recording medium transport direction), and an abutment portion H1511 in a direction Z (ink discharge direction). The ink supply member H1500 also has a terminal fixing portion H1512 that positions and fixes the electric contact substrate H2200 of the recording element unit H1002. A plurality of ribs is provided in and around the terminal fixing portion H1512 so as to improve the rigidity of a surface having the terminal fixing portion H1512.

(1-4) Integration of the Recording Head Unit and the Ink Supply Unit

As shown in FIG. 2, the recording head H1001 is completed by integrating the recording element unit H1002 with the ink supply unit H1003 and also with the tank holder H2000 in a manner described below.

Ink supply ports of the recording element unit H1002 (ink supply ports H1201 of the first plate H1200) and ink supply ports of the ink supply unit H1003 (ink supply ports H1602 of the flow path forming member H1600) are bonded together by screws H2400 through the joint rubber H2300 so that they can communicate with each other so as to prevent leakage of ink. At the same time, the recording element unit H1002 is correctly positioned and fixed at reference positions in the directions X, Y and Z of the ink supply unit H1003.

Figure 7:
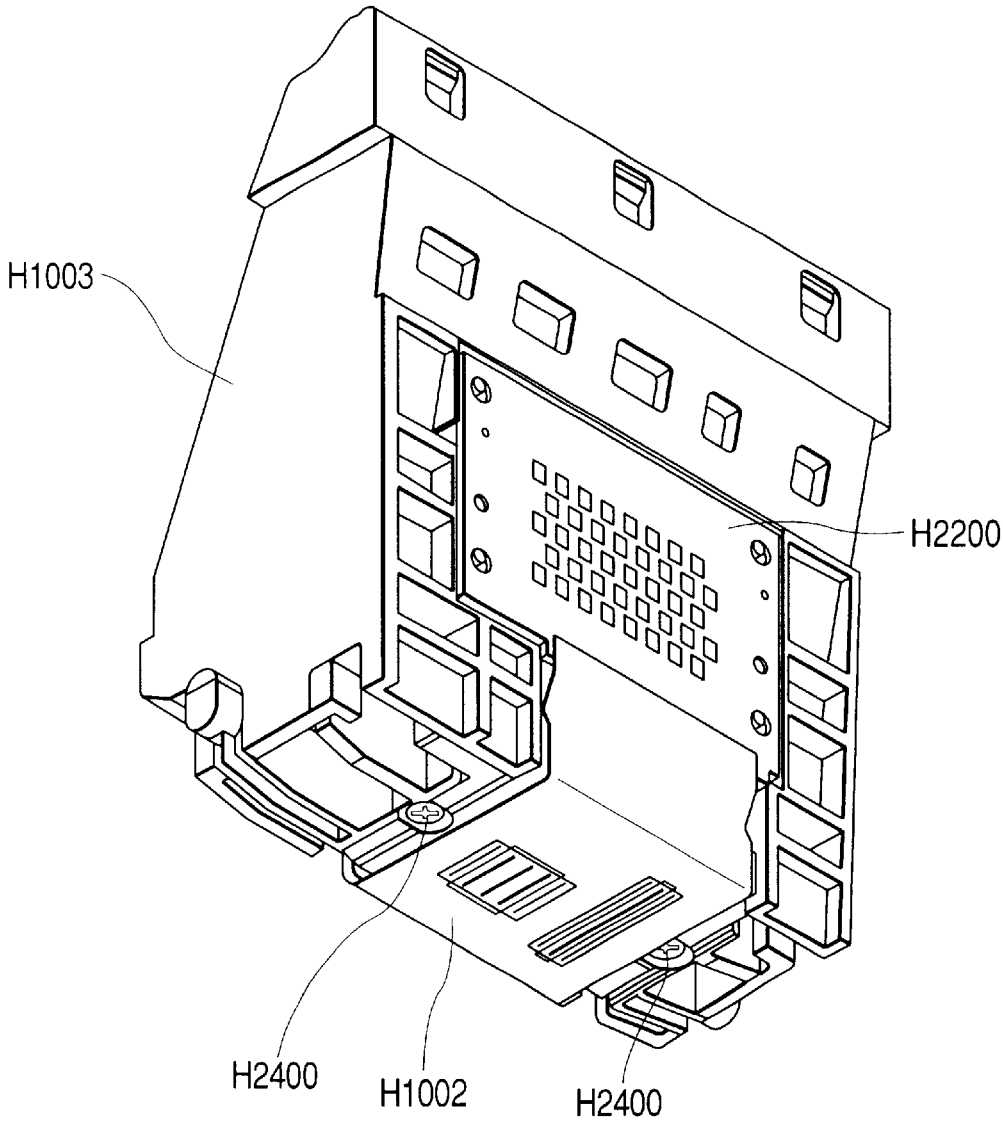
FIG. 7 is a perspective view showing the state in which the recording element unit is integrated with the ink supply unit.

The electric contact substrate H2200 of the recording element unit H1002 is positioned and fixed at one side of the ink supply member H1500 by terminal positioning pins H1515 (two) and terminal positioning holes H1309 (two). To fix the electric contact substrate H2200, for example, terminal connecting holes H1310 formed in the electric contact substrate H2200 are caulked by terminal connecting pins H1515 provided in the ink supply member H1500. The electric contact substrate H2200, however, may be fixed in other ways. FIG. 7 shows the state in which the recording element unit H1002 is integrated with the ink supply unit H1003 in the above-mentioned manner.

Further, the connecting holes and portions of the ink supply member H1500 with the tank holder H2000 are engaged with the tank holder H2000 to complete the recording head H1001. FIG. 8 shows the recording head H1001 that is completed by integrating the ink supply unit H1003 and the recording element unit H1002 with the tank holder H2000.

(2) Description of the Recording Head Cartridge

As shown in FIGS. 1A and 1B, the respective ink tanks mounted in the recording head H1001 constituting the recording head cartridge H1000 contains the ink of corresponding colors as stated previously. In the case of the embodiment shown in FIG. 8, an ink supply port H1907 for supplying ink in the ink tanks H1901, H1902, H1903 and H1904 to the recording head H1001 is formed in the respective ink tanks H1901, H1902, H1903 and H1904. For example, if the ink tank H1901 is mounted in the recording head H1001, the ink supply port H1907 of the black ink tank H1901 is welded to the filter H1700 provided in the joint H1517 of the recording head H1001, and black ink contained in the black ink tank H1901 is supplied to the first recording element substrate H1100 via the first plate H1200 through the ink flow path H1501 of the recording head H1001. The embodiment shown in FIGS. 1A and 1B has the same structure.

Ink is then supplied to the electrothermal converting elements H1103 and a bubbling chamber, not shown, having a discharge port H1107, and thermal energy applied to the electrothermal converting elements H1103 causes the ink to be discharged toward a recording sheet as medium to be recorded.

Ink Jet Recording Apparatus

Figure 12:
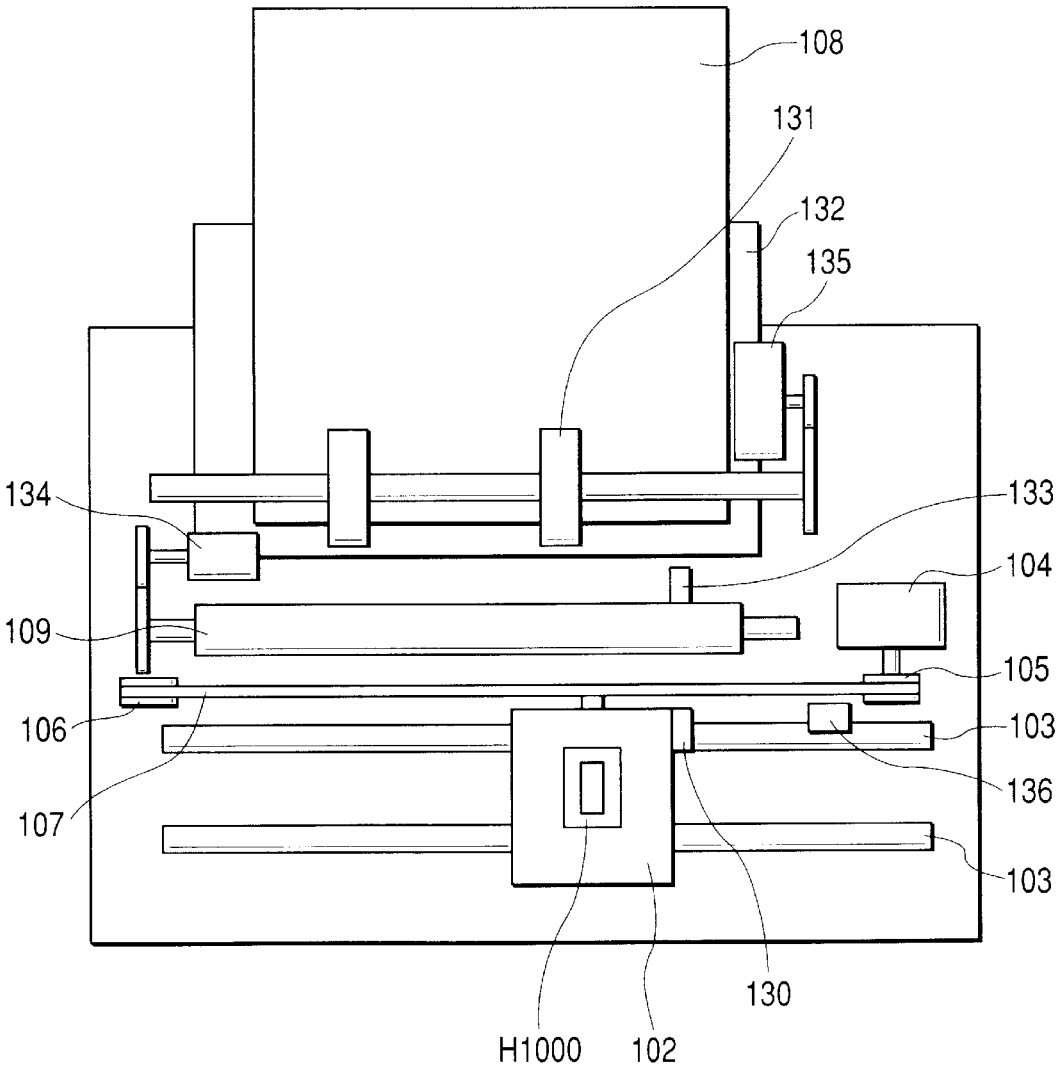
FIG. 12 is an explanatory view showing an example of a recording apparatus on which the ink jet recording head according to the present invention can be mounted.

Finally, there will be described a liquid discharge recording apparatus that is capable of mounting thereon the above-mentioned cartridge recording head. FIG. 12 is an explanatory view showing an example of a recording apparatus that is capable of mounting thereon the ink jet recording head according to the present invention.

In the recording apparatus shown in FIG. 12, the recording head cartridge H1000 in FIGS. 1A and 1B is positioned and exchangeably mounted in a carriage 102. The carriage 102 is provided with a plurality of electric connecting portions serving as terminals that come into contact with the respective external signal input terminals H1301 on the cartridge H1000 to transmit drive signals and the like to the respective discharge portions through the external signal input terminals H1301. Therefore, in the state in which the recording head cartridge H1000 is mounted in the carriage 102, the respective external signal input terminals H1301 on the recording head cartridge H1000 are electrically connected with the terminals of the carriage 102, i.e., the terminals of the recording apparatus.

The carriage 102 is guided and supported by a guide shaft 103, which is installed in the recording apparatus body so as to extend in a main scanning direction, so that it can freely move forward and backward. A main scan motor 104 drives the carriage 102 and controls the position and movement thereof through drive mechanisms such as a motor pulley 105, a driven pulley 106 and a timing belt 107. The carriage 102 is provided with a home position sensor 130. It is therefore possible to know the position of a shielding plate 136 when the home position sensor 130 on the carriage 102 passes through it.

A recording medium 108 such as a printing sheet and a plastic sheet is fed from an automatic sheet feeder (hereinafter referred to as "ASF") on a sheet-by-sheet basis by rotating a pickup roller 131 from a feed motor 135 via a gear. Further, the rotation of a transport roller 109 transports (sub-scans) the recording medium 108 via a position (printing section) opposite to the discharge port side of the recording head cartridge H1000. The rotation of an LF motor 134 rotates the transport roller 109 via a gear. At this time, whether the sheet has been fed or not and a leading position in sheet feeding are determined at a point in time when the recording medium 108 passes through a paper end sensor 133. Further, the paper end sensor 133 is used to finally find where the back end of the recording medium 108 is actually located and find a present recording position according to the actual back end.

Note that the reverse side of the recording medium 108 is supported by a platen (not shown) so that it can form a flat printing surface in the printing section. In this case, the recording head cartridge H1000 mounted on the carriage 102 is held in such a position that the discharge port surface thereof projects downward from the carriage 102 to be parallel with the recording medium 108 between the two pairs of transport rollers.

The recording head cartridge H1000 is mounted on the carriage 102 such that the arrangement direction of discharge ports thereof in the respective discharge portions intersects the scanning direction of the carriage 102, and discharges a liquid through the rows of the discharge ports to make records.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ink jet recording head, comprising:

a plurality of recording element substrates having a plurality of recording elements for discharging a recording liquid, and a supply port for supplying the recording liquid to said recording elements;

an electric contact substrate having a plurality of input terminals electrically connected to terminals of a recording apparatus body; and an electric wiring tape connected to said plurality of recording element substrates and said electric contact substrate such that said input terminals of said electric contact substrate are electrically connected to said recording elements of said recording element substrates, wherein a width of said electric contact substrate is greater than that of said electric wiring tape in a lateral direction perpendicular to a longitudinal direction in which said electric contact substrate and said electric wiring tape are arranged, and said input terminals are arranged in the lateral direction and the longitudinal direction on one surface of said electric contact substrate, and a relationship of m>n is satisfied if the maximum number of said input terminals arranged in the lateral direction is assumed to be m and the maximum number of said input terminals arranged in the longitudinal direction is assumed to be n, and wherein one of said plurality of recording element substrates is a recording element substrate of a predetermined color for use in discharging a recording liquid of the predetermined color, and among said input terminals on said electric contact substrate, only ones of said input terminals electrically connected to said recording element substrate of the predetermined color are arranged in an outermost row of said input terminals at a side of said electric contact substrate opposite said electric wiring tape.

2. An ink jet recording apparatus in which an ink jet recording head according to claim 1 may be detachably mounted, comprising:

a carriage having a plurality of terminals that come into contact with said input terminals of said electric contact substrate of said ink jet recording head so as to be electrically connected to said input terminals in a state in which said ink jet recording head is detachably mounted in said ink jet recording apparatus, wherein each of said recording element substrates of said ink jet recording head discharges a recording liquid in connection with scanning of said carriage to thereby record on a recording medium.

3. An ink jet recording head according to claim 1, wherein the predetermined color is black.

4. An ink jet recording head according to claim 1, wherein n rows, each comprising m input terminals arranged in the lateral direction, extend in the lateral direction and are arranged in the longitudinal direction on said electric contact substrate.

5. An ink jet recording head, comprising:

a plurality of recording element substrates having a plurality of recording elements for discharging a recording liquid, and a supply port for supplying the recording liquid to said recording elements;

an electric contact substrate having a plurality of input terminals electrically connected to terminals of a recording apparatus body; and an electric wiring tape connected to said plurality of recording element substrates and said electric contact substrate such that said input terminals of said electric contact substrate are electrically connected to said recording elements of said recording element substrates, wherein a width of said electric contact substrate is greater than that of said electric wiring tape in a lateral direction perpendicular to a longitudinal direction in which said electric contact substrate and said electric wiring tape are arranged, and said input terminals are arranged in the lateral direction and the longitudinal direction on one surface of said electric contact substrate, and a relationship of m>n is satisfied if the maximum number of said input terminals arranged in the lateral direction is assumed to be m and the maximum number of said input terminals arranged in the longitudinal direction is assumed to be n, and wherein said plurality of input terminals are arranged such that head driving voltage input terminals, logic system voltage input terminals, and ground terminals are not arranged adjacent to one another.

6. An ink jet recording apparatus in which an ink jet recording head according to claim 5 may be detachably mounted, comprising:

a carriage having a plurality of terminals that come into contact with said input terminals of said electric contact substrate of said ink jet recording head so as to be electrically connected to said input terminals in a state in which said ink jet recording head is detachably mounted in said ink jet recording apparatus, wherein each of said recording element substrates of said ink jet recording head discharges a recording liquid in connection with scanning of said carriage to thereby record on a recording medium.

7. An ink jet recording head according to claim 5, wherein n rows, each comprising m input terminals arranged in the lateral direction, extend in the lateral direction and are arranged in the longitudinal direction on said electric contact substrate.

* * * * *